United States Patent [19]

Biceroglu

[11] Patent Number: 4,485,006

[45] Date of Patent: Nov. 27, 1984

[54] START-UP METHOD FOR A HYDROREFINING PROCESS

[75] Inventor: Omer Biceroglu, Sarnia, Canada

[73] Assignee: Exxon Research and Engineering Co., Florham Park, N.J.

[21] Appl. No.: 463,398

[22] Filed: Feb. 3, 1983

Related U.S. Application Data

[63] Continuation-in-part of Ser. No. 354,665, Mar. 4, 1982, abandoned.

[51] Int. Cl.[3] ..... C10G 45/08

[52] U.S. Cl. ..... 208/216 R; 208/251 H; 208/254 H

[58] Field of Search ..... 208/213, 216 R, 210, 208/251 H, 254 H

[56] References Cited

U.S. PATENT DOCUMENTS

| | | | |
|---|---|---|---|
| 2,954,339 | 9/1960 | Beavon | 208/216 |
| 3,368,965 | 2/1968 | Schuman | 208/143 |
| 3,423,307 | 1/1969 | McKinney et al. | 208/213 |
| 3,528,910 | 9/1970 | Haney et al. | 208/216 |
| 3,953,214 | 4/1976 | Ganster et al. | 208/216 |
| 4,098,721 | 7/1978 | Ganster et al. | 208/215 X |
| 4,149,965 | 4/1979 | Pine et al. | 208/216 |

*Primary Examiner*—Carl F. Dees
*Assistant Examiner*—O. Chaudhuri
*Attorney, Agent, or Firm*—Marthe L. Gibbons

[57] ABSTRACT

A hydrorefining process for heavy hydrocarbonaceous oils, such as gas oils, is initiated by contacting a sulfided hydrorefining catalyst, such as nickel-molybdenum on alumina, with a light hydrocarbonaceous oil boiling in the range of $C_5$ to 700° F., in the presence of hydrogen, at specified conditions and, thereafter, contacting the catalyst with the heavy hydrocarbonaceous oil to be hydrorefined.

9 Claims, 1 Drawing Figure

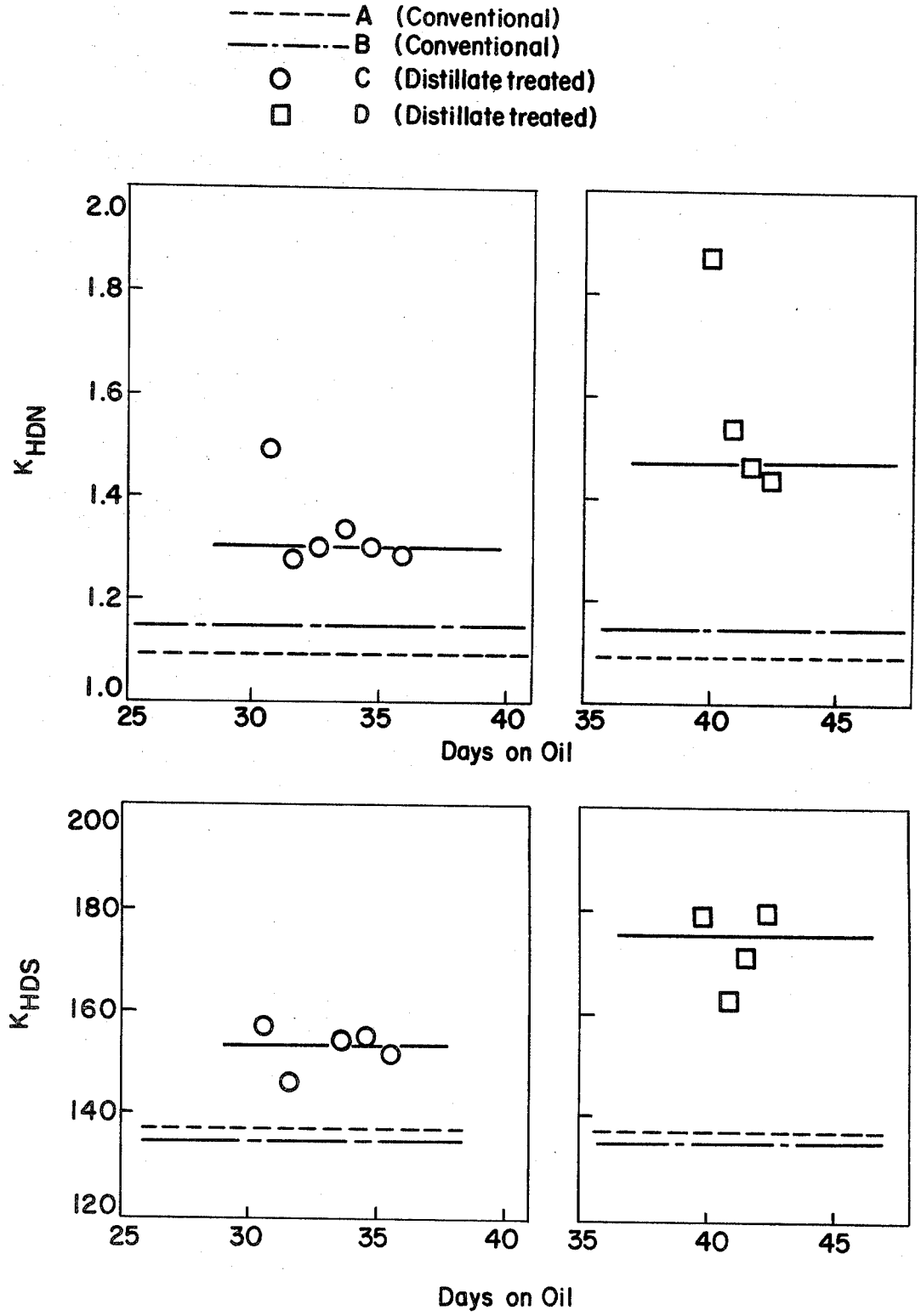
A (Conventional)
B (Conventional)
C (Distillate treated)
D (Distillate treated)
$K_{HDN}$
2.0
1.8
1.6
1.4
1.2
1.0
25
30
35
40
35
40
45
Days on Oil
$K_{HDS}$
200
180
160
140
120
25
30
35
40
35
40
45
Days on Oil

START-UP METHOD FOR A HYDROREFINING PROCESS

This application is a continuation-in-part of U.S. patent application 354,665 filed Mar. 4, 1982, now abandoned, the teachings of which are hereby incorporated by reference.

BACKGROUND OF THE INVENTION

1. Field of the Invention

This invention relates to a start-up process for hydrorefining heavy hydrocarbonaceous oils.

2. Description of the Prior Art

Hydrorefining is a well-known process for upgrading a variety of hydrocarbon fractions. The term "hydrorefining" is used herein to designate a catalytic treatment in the presence of hydrogen, of a hydrocarbonaceous oil, to upgrade the oil by eliminating or reducing the concentration of contaminants in the oil such as sulfur compounds, nitrogenous compounds, metal contaminants and/or partial saturation of the oil.

U.S. Pat. Nos. 3,953,321 and 4,098,721 disclose a hydrodesulfurization process for heavy hydrocarbonaceous oils such as gas oils in which a conventional hydrodesulfurization catalyst is sulfided and heat treated at a temperature of 750° to 850° F. prior to initiating the hydrodesulfurization. The catalyst is sulfided by contact with a lighter boiling range oil (column 3, lines 59–68) or is heat treated in the presence of the lighter oil, free from sulfur (column 4, lines 14–19).

U.S. Pat. No. 2,954,339 discloses use of a spent cobalt-molybdenum-alumina catalyst for hydrodesulfurization of a hydrocarbonaceous oil which may be a gas oil. Prior to contact with the gas oil, the catalyst is used to hydrotreat naphtha.

U.S. Pat. No. 3,423,307 discloses a start-up method for a hydrodesulfurization process for heavy residual feeds which contain asphaltic materials. The catalyst is initially contacted with an asphaltic-free feed.

U.S. Pat. No. 3,528,910 discloses a hydrotreating process for hydrocarbonaceous oils. A catalyst, such as a supported nickel-molybdenum catalyst, is sulfided in the presence of hydrogen with a distillate containing disulfide sulfur prior to the hydrotreating reaction.

U.S. Pat. 4,149,965 discloses a start-up process for hydrorefining of naphtha. The catalyst is partially deactivated by treatment with a substantially non-metal containing hydrocarbon oil in the presence of hydrogen prior to contacting the catalyst with the naphtha feed.

U.S.Pat. No. 3,368,965 discloses a slurry hydrogenation process in which a catalyst, such as cobalt molybdate on alumina, is pretreated by wetting the catalyst with a clean (i.e. non-aromatic) hydrocarbonaceous oil such as a lubricating oil fraction to form a slurry which is then introduced into the hydrocarbonaceous oil to be hydrogenated.

It has now been found that by pretreating a sulfided hydrorefining catalyst with a light hydrocarbonaceous oil in the presence of hydrogen prior to hydrorefining the heavy hydrocarbonaceous oil feed, the initial activity of the catalyst can be increased.

All boiling points to which reference is made herein are atmospheric boiling points unless otherwise specified.

The Periodic Table referred to herein is in accordance with *Handbook of Chemistry and Physics,* published by the Chemical Rubber Company, Cleveland, Ohio, 45th Edition, 1954.

SUMMARY OF THE INVENTION

In accordance with the invention there is provided, in a hydrorefining process which comprises contacting a heavy hydrocarbonaceous oil having a boiling point ranging from about 650° F. to about 1050° F. with hydrogen in the presence of a sulfided hydrorefining catalyst comprising a hydrogenation component selected from the group consisting of Group VIB metal components and Group VIII non-noble metal components and an alumina-containing support, at hydrorefining conditions, the improvement which comprises initially contacting said sulfided catalyst with a hydrocarbonaceous oil lighter than said heavy oil feed, in the presence of hydrogen, at a temperature ranging from about 500° to about 725° F., for at least 2 days, and subsequently contacting said catalyst with said heavy oil at said hydrorefining conditions.

BRIEF DESCRIPTION OF THE DRAWING

The FIGURE shows graphs of catalyst activity versus days on oil.

DETAILED DESCRIPTION OF THE INVENTION

The start-up method of the present invention is suited for use at the beginning of a process for hydrorefining heavy hydrocarbonaceous oil feeds utilizing a hydrorefining catalyst that has already been sulfided in a conventional manner. The sulfided hydrorefining catalyst is contacted with a hydrocarbonaceous oil lighter than the hydrocarbonaceous oil feed which is to be hydrorefined, at conditions shown in Table I.

TABLE I

LIGHT OIL TREATMENT CONDITIONS

| Conditions | Broad Range | Preferred Range |
|---|---|---|
| Temperature, °F. | 500–750 | 600–700 |
| Pressure, psig | 500–3500 | 800–3000 |
| Liquid hourly space velocity, V/HR/V | 0.05–5.0 | 0.1–3.0 |
| Hydrogen Rate, SCF/B | 300–20,000 | 600–12,000 |
| Hydrogen Partial Pressure, psig | 500–3500 | 650–2500 |

Suitable hydrorefining catalysts for use in the process comprise a hydrogenation component and an alumina-containing support. The hydrogenation component is selected from the group consisting of Group VIB metal component and a non-noble Group VIII metal components and mixtures thereof, such as cobalt, molybdenum, nickel, tungsten and mixtures thereof. The alumina-containing support may comprise a minor amount of another inorganic oxide such as silica, magnesia, boria, zirconia, strontia, hafnia, phosphorous oxide and mixtures thereof. Preferably, the support is an alumina-containing support which additionally comprises minor amounts of silica, such as for example from 1 to 6 percent silica, based on the weight of the support. Such catalysts are described, for example, in U.S. Pat. Nos. 3,770,618 and 3,509,044 and 4,113,656, the teachings of which are hereby incorporated by reference. The preferred catalyst comprises molybdenum and cobalt or nickel on an alumina support containing from 1 to 6 percent silica, based on the support. The hydrogenation component of the catalyst may initially be present as elemental metal, metal oxide, metal sulfide and mixtures thereof of the stated metals. When the initial hydrogenation component is not in the sulfided state, then the catalyst, e.g. the nickel oxide-containing catalyst, is sulfided in a conventional manner well-known in the art prior to the contacting step of the present invention with the light hydrocarbon oil. Suitable lighter hydrocarbon oils for initial contact with the already sulfided catalyst include hydrocarbonaceous oils having an atmospheric pressure boiling point not greater than about 700° F., preferably a boiling point ranging from about $C_5$ to not greater than about 700° F. The contacting with the lighter oil is conducted for at least 2 days. After the catalyst has been contacted with a light oil, for the required time, in the presence of hydrogen and at the above given conditions, the catalyst is contacted with a heavy oil feed to be hydrorefined at hydrorefining conditions. The contact of the light oil may be discontinued prior to contacting immediately with the heavy oil or the heavy oil may be gradually contacted with the catalyst while there is still some light oil present. When the heavy oil is contacted with The catalyst while the light oil is still present, the contact with the light oil is continued, preferably for at least a time sufficient for the sulfur concentration in the hydrorefined oil product, under the given operating conditions to be appoximately constant (that is, a period at least sufficient to obtain a line-out of product sulfur concentration). Eventually, the flow of light oil to contact the catalyst is discontinued. It should also be noted that a hydrogen-containing gas is being introduced into the hydrorefining zone during the light oil pretreatment of the catalyst as well as during the hydrorefining reaction stage. The contacting of the heavy oil feed with the catalyst is performed immediately after the contacting of the catalyst with a light oil without any intervening treatment steps such as heat treating steps. Suitable heavy oil feeds to be hydrorefined include oils which are substantially asphaltene-free and which boil in the range of about 650° F. to about 1050° F. at atmospheric pressure, such as gas oils. The hydrocarbonaceous oils may be derived from any source such as tar sand oils, shale oil, liquids derived from coal liquefaction processes and mixtures thereof. The oils to be hydrorefined comprise at least 0.25 weight percent sulfur and may comprise up to 8 weight percent sulfur and may additionally comprise up to 4 weight percent nitrogen usually present as organic sulfur compounds and organic nitrogen compounds.

Suitable operating conditions in the hydrorefining zone are summarized in Table II.

TABLE II

| HYDROREFINING OPERATING CONDITIONS | | |
|---|---|---|
| Conditions | Broad Range | Preferred Range |
| Temperature, °F. | 600–900 | 650–850 |
| Pressure, psig | 600–3500 | 800–3200 |
| Liquid hourly space velocity, V/V/HR | 0.05–5.0 | 0.1–2.5 |
| Hydrogen rate, SCF/BBL | 300–20,000 | 600–12,000 |
| Hydrogen partial pressure, psig | 500–3000 | 800–2500 |

The catalyst may be disposed in the hydrorefining reaction zone as a fixed bed, moving bed, dispersed phase, fluidized bed, ebullating bed or a slurry. The process of the present invention is particularly suited for use in fixed bed processes. Contact of the heavy oil feed in the presence of hydrogen and the catalyst at hydrorefining conditions produces a hydrorefined heavy oil having a decreased content of sulfur and nitrogen contaminants.

PREFERRED EMBODIMENT

The following example is presented to illustrate the invention.

EXAMPLE

Comparative hydrorefining runs were made utilizing the start-up procedure of the present invention and conventional start-up procedures. The catalyst used in all the runs was the same catalyst, that is, a conventional nickel-molybdenum-alumina catalyst containing about 3 percent nickel, calculated as nickel oxide, and about 15 percent molybdenum, calculated as molybdenum oxide. The catalyst was sulfided in the conventional manner by contact with a blend of 10 volume percent hydrogen sulfide and hydrogen. The feed used in the hydrorefining runs was the same heavy hydrocarbonaceous oil feed having a boiling point ranging from about 650° to about 1050° F., a sulfur content of 2.3 weight percent and a nitrogen content of 0.1 weight percent. The feed was substantially free of asphaltenes.

In runs A and B, which simulate a conventional start-up procedure, the heavy oil was introduced into the reaction zone immediately after the catalyst had been sulfided. In runs C and D, which are runs in accordance with the start-up procedure of the present invention, the sulfided catalyst was contacted with a light hydrocarbonaceous oil having a boiling point ranging from $C_5$ to 700° F. in the presence of hydrogen for about 30 to about 40 days at the conditions given in Table III prior to introducing the heavy oil to be hydrorefined into the hydrorefining zone.

The light oil treatment conditions used in Runs C and D are summarized in Table III.

TABLE III

| LIGHT OIL TREATMENT CONDITIONS | | |
|---|---|---|
| Conditions | Run C | Run D |
| Temperature, °F. | 629–662 | 630 |
| Hydrogen pressure, psig | 1200 | 1200 |
| Liquid hourly space velocity, V/HR/V | 0.3–1.0 | 0.5 |
| Hydrogen Rate, SCF/B | 3000 | 3000 |

The hydrorefining conditions and results of these runs are summarized in Table IV.

TABLE IV

| Hydrorefining Conditions | | | | | | | |
|---|---|---|---|---|---|---|---|
| Runs | T, °C. | P, kPa | LHSV | % HDN[1] | % HDS[2] | Relative Catalyst Requirement | Temperature for HDN, °C. |
| A | 371.0 | 8964 | 0.99 | 78.1 | 96.2 | 100 | 0 |
| B | 370.9 | 8998 | 0.99 | 79.5 | 96.1 | 95 | −1 |

TABLE IV-continued

| Runs | Hydrorefining Conditions T, °C. | P, kPa | LHSV | % HDN[1] | % HDS[2] | Relative Catalyst Requirement | Temperature for HDN, °C. |
|---|---|---|---|---|---|---|---|
| C - Activation with light oil for 30 days followed by heavy oil | 371.5 | 8964 | 1.00 | 84.9 | 97.3 | 84 | −5 |
| D - Activation with light oil for 40 days followed by heavy oil | 371.0 | 8950 | 0.99 | 89.1 | 98.0 | 62 | −9 |

[1]% HDN = % hydrodenitrogenation = 100 × (wt. % nitrogen in feed minus wt. % nitrogen in product) divided by wt. % nitrogen in feed.
[2]% HDS = % hydrodesulfurization = 100 × (wt. % sulfur in feed minus wt. % sulfur in product) divided by wt. % sulfur in feed.

The hydrodesulfurization and hydrodenitrogenation activities of the catalyst in runs A, B, C and D, that is, without light oil treatment and with light oil treatment, versus days on oil is shown in the four graphs in the accompanying FIGURE.

As can be seen from Table IV, runs C and D showed increased catalyst activity. The increased activity can be used to decrease the catalyst requirement or to decrease the start of the run temperature.

As can be seen from the FIGURE, the hydrodenitrogenation and hydrodesulfurization rate constants of the catalyst in runs C and D (runs in accordance with the present invention) were lined out and the catalyst maintained a higher level of activity than the catalyst of runs A and B, which had not been treated in accordance with the present invention.

What is claimed is:

1. In a hydrorefining process which comprises contacting a heavy hydrocarbonaceous oil feed having a boiling point ranging from about 650° to about 1050° F. with hydrogen in the presence of a sulfided hydrorefining catalyst comprising a hydrogenation component selected from the group consisting of Group VIB metal component, Group VIII non-noble metal component and mixtures thereof, and an alumina-containing support, at hydrorefining conditions, the improvement which comprises initially contacting said sulfided catalyst with a hydrocarbonaceous oil lighter than said heavy oil feed, in the presence of hydrogen at a temperature ranging from about 600° to about 700° F., for at least two days, and subsequently contacting said catalyst with said heavy oil feed at said hydrorefining conditions.

2. The process of claim 1 wherein said lighter oil has a boiling point ranging from about $C_5$ to a final boiling point not greater than about 700° F.

3. The process of claim 1 wherein said heavy oil feed is a substantially asphaltene-free oil.

4. The process of claim 1 wherein said heavy oil feed comprises from about 0.25 to about 8 weight percent sulfur.

5. The process of claim 1 wherein said hydrorefining conditions include a temperature ranging from about 600° to 900° F. and a total pressure ranging from about 600 to about 3500 psig.

6. The process of claim 1 wherein said hydrogenation component comprises a metal selected from the group consisting of nickel, cobalt, molybdenum, tungsten, and mixtures thereof.

7. The process of claim 1 wherein said support comprises alumina and additionally comprises a minor amount of silica.

8. The process of claim 1 wherein said initial contacting of said catalyst with said light oil and said subsequent contacting with said heavy oil feed are performed without any intervening treatment steps.

9. A method for starting up a hydrorefining process for a heavy hydrocarbonaceous oil feed, which comprises:

(a) contacting a sulfided hydrorefining catalyst comprising a hydrogenation component selected from the group consisting of at least one Group VIB metal component and at least one non-noble metal Group VIII metal component and an alumina-containing support with a hydrocarbonaceous oil lighter than said feed, said lighter hydrocarbonaceous oil having a boiling point ranging from about $C_5$ to not greater than about 700° F., in the presence of hydrogen, at a temperature ranging from about 600° to about 700° F. and a total pressure ranging from about 800 to about 3000 psig, for at least 2 days, and (b) contacting the catalyst resulting from step (a) with a substantially asphaltene-free heavy hydrocarbonaceous oil feed boiling in the range of about 650° to about 1050° F. in the presence of hydrogen at hydrorefining conditions, and (c) recovering a hydrorefined heavy hydrocarbonaceous oil.

* * * * *